US006159132A

United States Patent [19]

Chang

[11] Patent Number: 6,159,132

[45] Date of Patent: Dec. 12, 2000

[54] OVAL-TRACKED EXERCISE DEVICE

[76] Inventor: Jack Chang, No. 195, Long San 2 Street, Da Ya Hsiang, Taichung Hsien, Taiwan

[21] Appl. No.: 09/265,430

[22] Filed: Mar. 10, 1999

[51] Int. Cl.[7] ..... A63B 22/06

[52] U.S. Cl. ..... 482/57; 482/62; 482/63; 482/64

[58] Field of Search ..... 482/51, 52, 57, 482/62, 63, 64, 65

[56] References Cited

U.S. PATENT DOCUMENTS

| | | | |
|---|---|---|---|
| 4,880,225 | 11/1989 | Lucas et al. | 272/73 |
| 5,290,212 | 3/1994 | Metcalf | 482/62 |
| 5,397,286 | 3/1995 | Chang | 482/62 |
| 5,823,919 | 10/1998 | Eschenbach | 482/62 |
| 5,916,065 | 6/1999 | McBride et al. | 482/57 |

*Primary Examiner*—Jerome W. Donnelly
*Assistant Examiner*—Tam Nguyen
*Attorney, Agent, or Firm*—Dougherty & Troxelll

[57] ABSTRACT

An oval-tracked exercise device includes a base assembly, a supporting frame assembly fastened on the base assembly, a treadle crank assembly fastened on the rear end of the supporting frame assembly and a wheel assembly fastened at the bottom end of the supporting frame assembly. The bottoms of the treadles have bottom shafts which are fixed to the bottom ends of the front standing shafts. In treading, the transmission gear assembly will be driven by the bottom shaft of the treadle crank assembly to rotate the wheel assembly, so that the front standing shafts and the handles are able to make a pivoting movement on the front lateral shaft in order for the user to exercise the whole body. When the handles are inserted into connecting tubes at the front end of the front lateral shaft, the handles are unable to swing with the front standing shaft and the user is able to exercise only the buttocks without moving the upper body.

3 Claims, 5 Drawing Sheets

OVAL-TRACKED EXERCISE DEVICE

BACKGROUND OF THE INVENTION

1. Field of the Invention

The present invention relates to an oval-tracked exercise device in which the bottoms of treadles are fitted with a bottom shaft which extend to the bottom end of the front standing shaft of the treadle crank assembly and fixed thereon. In treading, the transmission gear assembly will be driven by the bottom shaft of the treadle crank assembly to rotate the wheel assembly, so that the front standing shaft is able to make a pivoting movement on the bearing of the front lateral shaft in order for the user to exercise the whole body. The supporting frame assembly is respectively welded with a connecting tube at a proper position on both sides of the front end thereof for inserting and fastening handles. A sleeve is welded respectively on both sides of the front end of the base assembly opposite to the position of the connecting tube for inserting and fastening the handle so that the handle is unable to swing with the front standing shaft and the user is able to exercise the buttocks without moving the upper body.

2. Description of the Prior Art

With the progress of modem time and the promotion of quality of life, people attach more and more importance to sport and leisure in addition to their work. However, many people are very involved with indoor gym devices replacing outdoor sport activities. At present, there are a number of gym devices to meet the consumers' requirement. And this invention is also aiming thereat.

SUMMARY OF THE INVENTION

It is a main object of the present invention to provide an oval-tracked exercise device which includes a base assembly, a supporting frame assembly fastened on the base assembly, a treadle crank assembly fastened on the rear end of the supporting frame assembly and a wheel assembly fastened on the supporting frame assembly so that the user is able to exercise the feet through treading.

It is another object of the present invention to provide an oval-tracked exercise device for users to exercise either the lower body or the whole body. The bottom ends of the treadles are fitted with a bottom shaft which is extended over to the bottom end of the front standing shaft of the treadle crank assembly and fixed thereon. In treading, the transmission gear assembly will be driven by the bottom shaft of the treadle crank assembly to rotate the wheel assembly, so that the front standing shaft is able to make a pivoting movement on the bearing of the front lateral shaft in order for the user to exercise the whole body. The supporting frame assembly is respectively welded with a connecting tube at a proper position of both sides of the front end thereof for inserting and fastening handles. A sleeve is welded respectively on both sides of the front end of the base assembly opposite to the position of the connecting tube for inserting and fastening the handle so that the handle is unable to swing with the front standing shaft and the user is able to exercise the buttocks without moving the upper body.

BRIEF DESCRIPTION OF THE DRAWINGS

The drawings disclose an embodiment of the present invention which serves to exemplify the various advantages and objects hereof, and are as follows.

DETAILED DESCRIPTION OF THE PREFERRED EMBODIMENT

Figure 1:
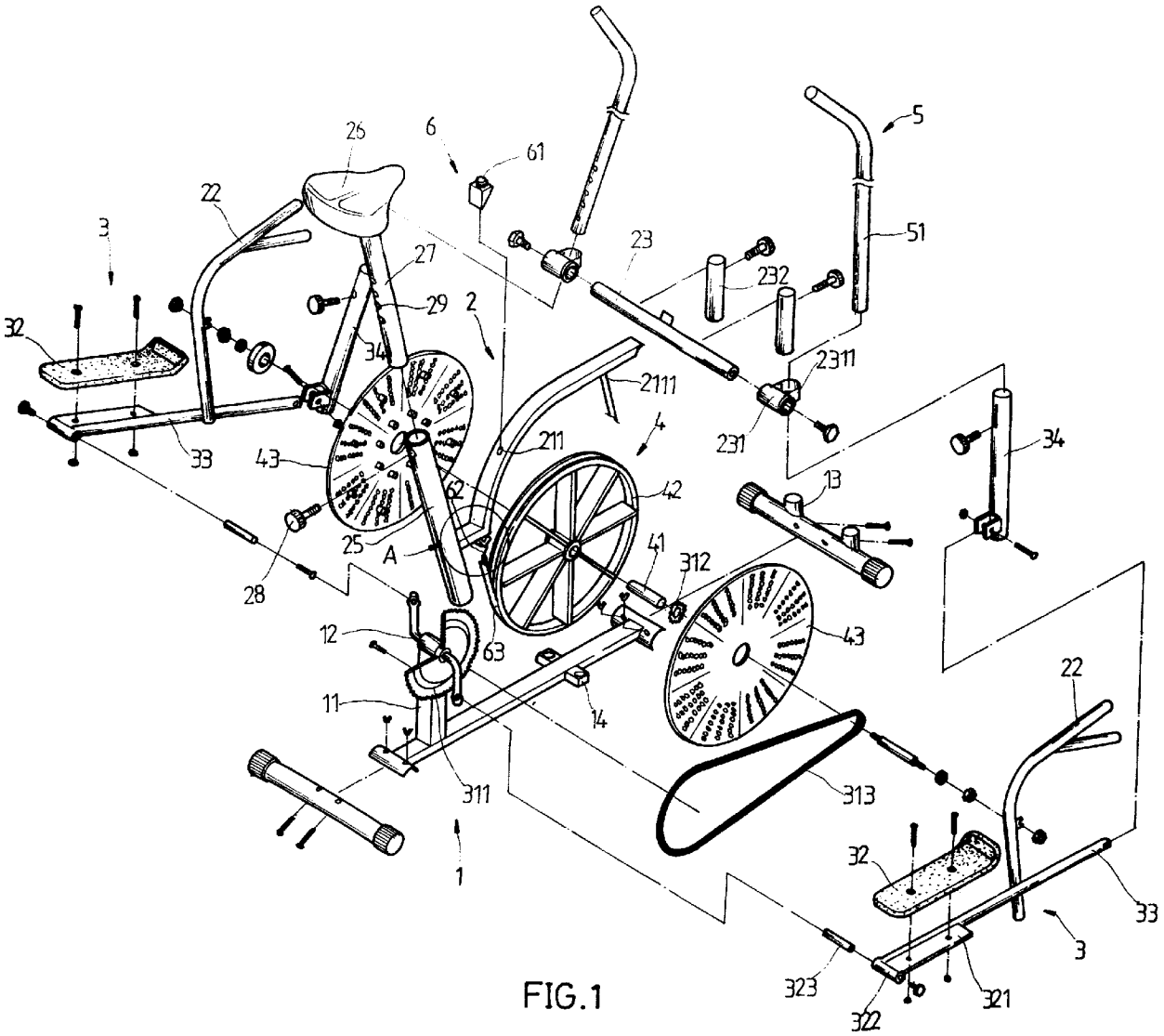
FIG. 1 is an exploded perspective view of the present invention.
Figure 2:
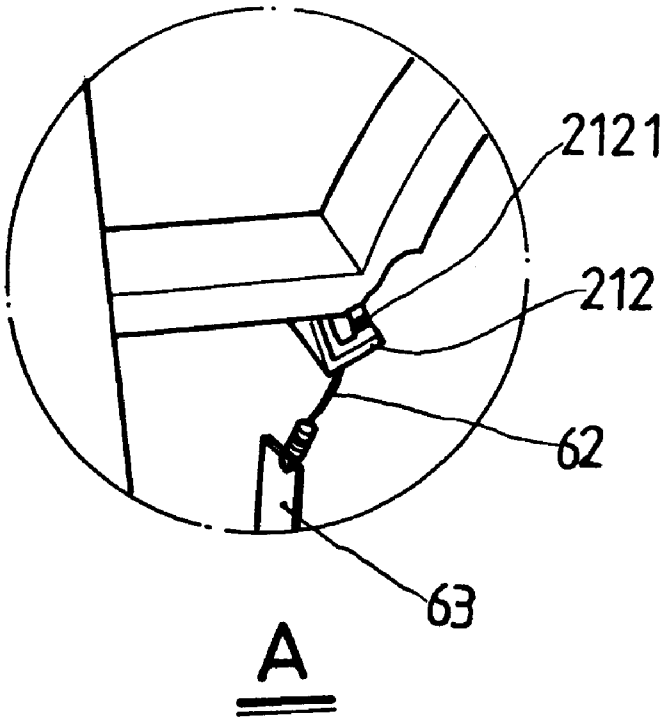
FIG. 2 is a partial, enlarged, view of the present invention.
Figure 3:
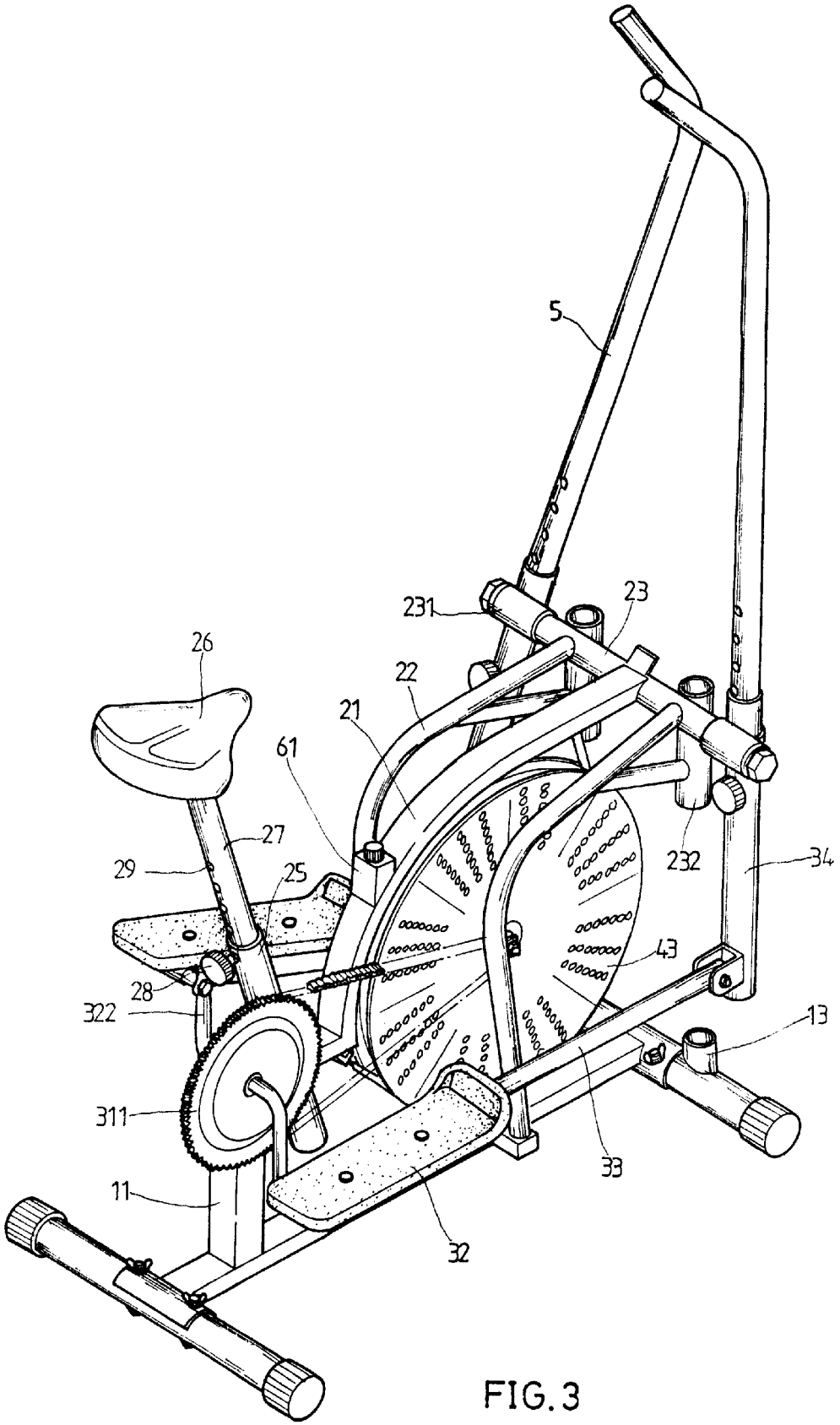
FIG. 3 is a perspective assembly view of the present invention.

Referring to FIGS. 1, 2 and 3, an oval-tracked exercise device in accordance with the present invention includes a base assembly 1, a supporting frame assembly 2 fastened on the base assembly 1, a treadle crank assembly 3 fastened on the rear end of the supporting frame assembly 2, a wheel assembly 4 fastened at the bottom end of the supporting frame assembly 2, a handle assembly 5 and a loading control assembly 6.

The base assembly 1 is I-shaped and the end thereof is fitted with a strut 11 having ears 14 protruding from two sides thereof to which two standing support bars 22 of the supporting frame assembly 2 are welded; the treadle crank assembly 3 is pivoted on the upper side of the strut 11 by means of a bearing 12, and an upper supporting bar 21 of the supporting frame assembly 2 is fixed thereon; two connecting sleeves 13 are respectively mounted on two sides of the front end of the base assembly 1 for inserting and fastening the handles 5.

The supporting frame assembly 2 includes an upper supporting bar 21, right and left symmetric standing support bars 22 and a front lateral shaft 23, wherein one end of the upper supporting bar 21 is attached to the upper side of the strut 11 of the base assembly 1 by hollow tube 25, while the other end is connected to the front lateral shaft 23 of the supporting frame assembly 2 to be a monoblock body. The upper supporting bar 21 is curved in accordance with the shape of the wheel assembly 4. Moreover, the upper supporting bar 21 has a hole 211 in a top end for inserting a steel wire 62 of the loading control assembly 6, fitted with a connecting strip 2111 on the lower end thereof, and fitted with an L-panel 212 at the bottom end thereof which includes a slot on the horizontal surface for inserting the steel wire 62.

One end of the upper supporting bar 21 is welded to an inclined hollow tube 25 for inserting a saddle tube 27 with a saddle 26. Also, the rear side of the hollow tube 25 near the upper site has a threaded button 28 through which the height of the saddle 26 is adjustable in coordination with a number of holes 29 in the saddle tube 25.

The standing support bars have an inverted L-shape and the bottom ends thereof are welded on the upper sides of the protruding ears 14 respectively while the other ends thereof are welded on the shaft body of the front lateral shaft 23 and the connecting tubes 232.

The front lateral shaft 23 is fixed on the front of the upper supporting bar 21 while the two ends thereof each have a pivoted bearing 231 respectively from which protruding ears 2311 extend for fixing the front standing shafts 34 of the treadle crank assembly 3. In addition, the front lateral shaft 23 has welded thereon connecting tubes 232 for inserting and fixing the handles 5.

The treadle crank assembly 3 includes a transmission gear assembly, two treadles 32, two bottom shafts 33 and two front standing shafts 34.

The transmission gear assembly comprises a great gear 311 mounted beside the bearing 12 of the strut 11, a small gear 312 mounted on the wheel assembly 4 and a drive chain 313 engaged with the great and the small gears 311, 312.

The treadles 32 are each fitted with a plate 321 respectively at the bottom thereof from which the bottom shaft 33 extends to the bottom end of the front standing shaft 34 and is fixed thereon. The plates 321 have bearings 322 which are respectively connected with a connecting shaft 323 of the great gear 311 so that the transmission gear assembly is able to rotate the wheel assembly 4.

The top ends of the front standing shafts 34 are fastened on the protruding ear 2311 of the front lateral shaft 23 while the bottom ends thereof are fastened on the bottom shafts 33 of the treadle crank assembly 3, so that, when the user treads, the front standing shafts 34 are pivoted on the front lateral shaft 23.

The wheel assembly 4 includes a turning axle 41 on which the small gear 312 of the transmission gear assembly is fastened, a turning wheel 42 mounted on the turniing axle 41 and two covers 43 respectively attached onto two sides of the turning wheel 42.

The handle assembly 5 has a number of positioning holes 51 through which a button is inserted to fasten the handle assembly 5 to the connecting tube 232 or to the front standing shaft 34.

The loading control assembly 6 includes an adjusting button 61 mounted on the upper supporting bar 21, a steel wire 62 one end of which passes through the hole 211 in the upper supporting bar 21 and is affixed to the adjusting button 61, while the other end thereof passes through the bottom end of the upper supporting bar 21 and which is connected to the damping band 63 after passing through a panel hole 2121 of the L-panel.

A damping band 63 has one end hooked with the connecting strip 2111 while the other end extends around the middle of the periphery of the turning wheel 42.

Thus, the tension of the steel wire 62 is adjustable by the adjusting button 61 in order to control the loading during treading on the oval-tracked exercise device.

Figure 4:
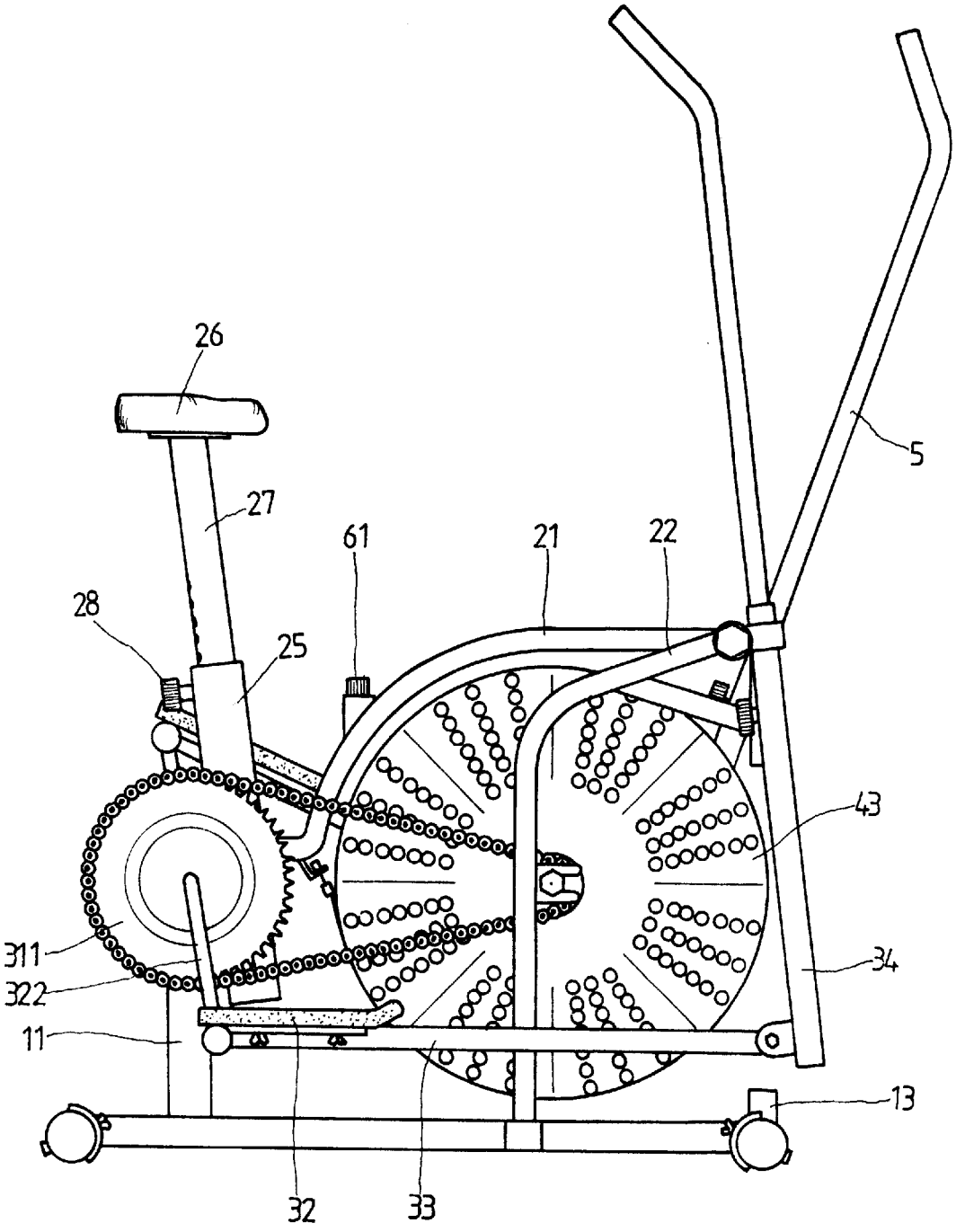
FIG. 4 is an embodiment of the present invention for exercising the whole body.
Figure 5:
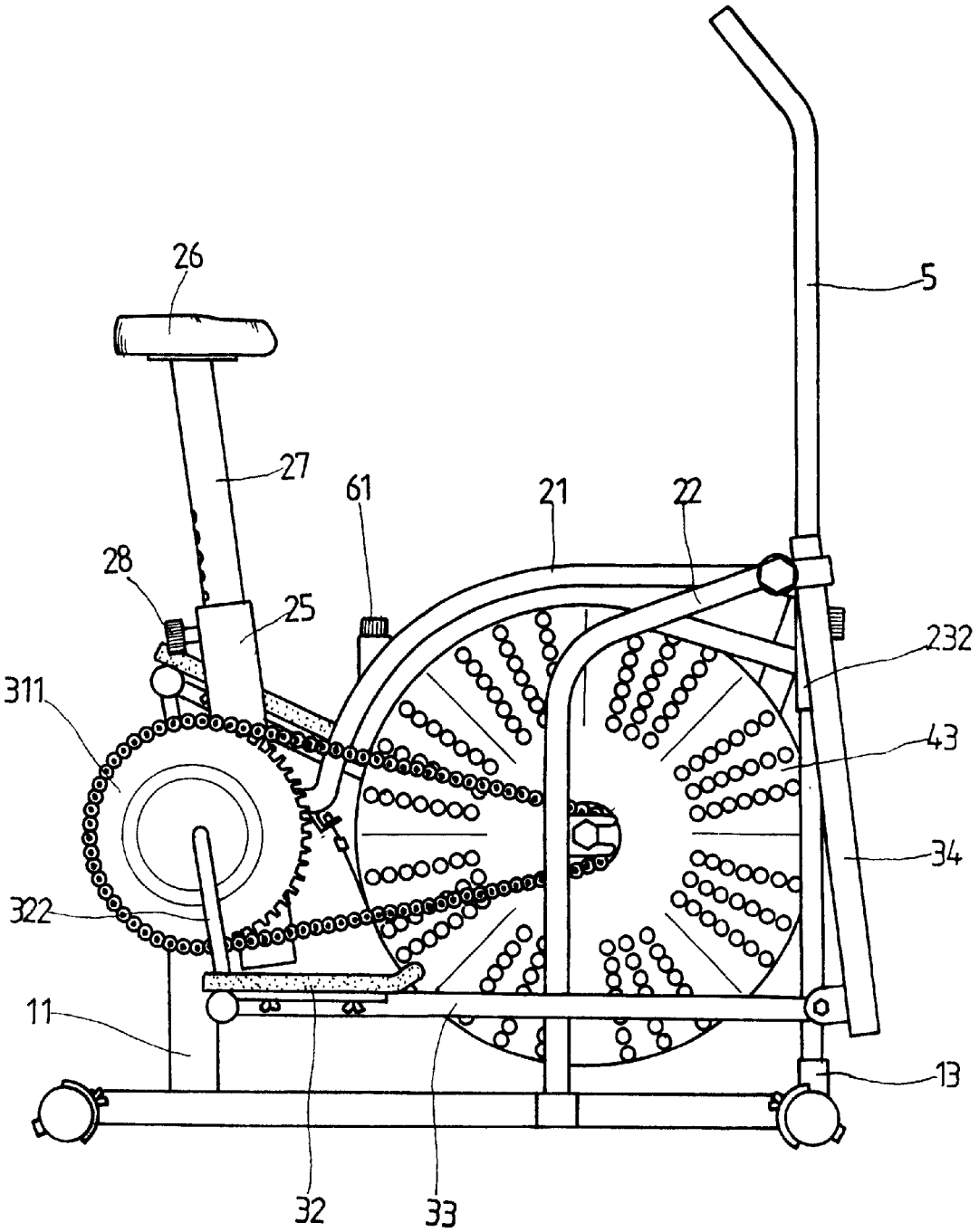
FIG. 5 is an embodiment of the present invention for exercising only the lower body.

The operation way is shown in FIGS. 4 and 5. FIG. 4 illustrates the device when a user exercises the whole body. The handle assembly 5 is inserted in the front standing shaft 34 and fixed thereon. In treading, the transmission gear assembly will be driven by the bottom shaft 33 of the treadle crank assembly 3 to rotate the wheel assembly 4, so that the front standing shafts 34 are able to make a pivoting movement on the bearings 231 of the front lateral shaft 23. Thus, the handle assembly 5 is swingable on the front standing shaft 34 in order for the user to exercise the whole body.

FIG. 5 shows the device when a user exercises only the buttocks. The supporting frame assembly 2 has connecting tubes 232 on the front end thereof for inserting and fastening handles 5. Sleeves 13 are welded respectively on the front end of the base assembly 1 opposite to the positions of the connecting tubes 232 for inserting and fastening the handle 5, so that the handle 5 is unable to swing about the front standing shaft 34. Thus, the upper body of the user stands still while only the feet of the lower body tread and the user is able to exercise only the buttocks.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An exercise device wherein treadles move in an oval track comprising:

an I-shaped base assembly having a strut at one end, two protruding ears positioned on opposite sides of the base; two standing support bars, each having a first end welded to one of the protruding ears and a second end; a seat assembly including a hollow tube affixed to the strut, a saddle tube inserted into the hollow tube and having a saddle thereon; an upper supporting bar having a first end attached to the hollow tube and a second end; a front lateral shaft affixed to the second ends of the upper supporting bar and the two standing support bars; two connecting sleeves affixed to the base assembly; two connecting tubes affixed to the front lateral shaft and aligned with the two connecting sleeves for receiving handles therein; two hollow front standing shafts pivotally attached to the front lateral shaft;

a wheel assembly rotatably mounted on the upper supporting bar and including a turning wheel and covers on opposite sides of the turning wheel;

a transmission assembly including a treadle crank rotatably mounted on the strut, a first gear mounted on the treadle crank, a second gear connected to the turning wheel, and an endless drive chain engaging the first and second gears such that rotation of the treadle crank rotates the turning wheel; two treadle plates, each including a bottom shaft, connected to the treadle crank, each of the bottom shafts connected to one of the front standing shafts; and a treadle attached to each treadle plate, whereby rotation of the treadle crank causes pivoting movement of the front standing shafts; and, handles mounted in the two front standing shafts.

2. The exercise device of claim 1 further comprising a loading control mechanism mounted on the upper supporting bar and engaging the turning wheel for varying a load imposed upon the rotation of the turning wheel.

3. The exercise device of claim 1 wherein the handles are removably mounted in the front standing shafts such that the handles may be removed from the front standing shafts and inserted into the connecting tubes and connecting sleeves whereby the handles are stationary during rotation of the treadle crank.

* * * * *